US012098498B2

(12) United States Patent
Felsenthal et al.

(10) Patent No.: US 12,098,498 B2
(45) Date of Patent: Sep. 24, 2024

(54) COLLAPSIBLE HAMPER WITH SWINGING LID

(71) Applicant: Whitmor, Inc., Southaven, MS (US)

(72) Inventors: Sandy Felsenthal, Memphis, TN (US); James Tabujara, Memphis, TN (US)

(73) Assignee: Whitmor, Inc., Southaven, MS (US)

( * ) Notice: Subject to any disclaimer, the term of this patent is extended or adjusted under 35 U.S.C. 154(b) by 0 days.

(21) Appl. No.: 17/964,017

(22) Filed: Oct. 11, 2022

(65) Prior Publication Data

US 2023/0114330 A1 Apr. 13, 2023

Related U.S. Application Data

(60) Provisional application No. 63/254,459, filed on Oct. 11, 2021.

(51) Int. Cl.
*D06F 95/00* (2006.01)

(52) U.S. Cl.
CPC ..... *D06F 95/002* (2013.01)

(58) Field of Classification Search
CPC ..... A47B 61/06; A47B 43/02; A47B 2220/0086; A47B 47/06; D06F 95/002
See application file for complete search history.

(56) References Cited

U.S. PATENT DOCUMENTS

| | | | | |
|---|---|---|---|---|
| 2,522,561 | A * | 9/1950 | Blechman | A47B 43/02 312/259 |
| 2005/0230390 | A1* | 10/2005 | Glenn | D06F 95/002 220/6 |
| 2008/0042533 | A1* | 2/2008 | Wang | A47B 43/02 312/259 |
| 2020/0109889 | A1* | 4/2020 | Kieling | F25D 3/08 |
| 2023/0018153 | A1* | 1/2023 | Bruns | A47B 43/02 |

* cited by examiner

*Primary Examiner* — Shawn M Braden
(74) *Attorney, Agent, or Firm* — Stites & Harbison PLLC; Richard S. Myers, Jr.; Patrick M. Torre

(57) ABSTRACT

A foldable hamper that has a ridged front wall and real wall; two ridged side walls engaging the front and real walls, forming an interior space; a lid that removably engages the front wall and the side walls, the lid having a top, two side flaps, door and door frame, the door being attached to the top of the door frame, and swings inward to the interior space to permit access to the interior space; wherein each side flap extends over the edge of a side wall and removably attaches to the side wall, and the door frame extends over the front wall and removably attaches to the front wall; and wherein the side walls have a seam that permits the side walls to inwardly bend toward one another.

14 Claims, 7 Drawing Sheets

COLLAPSIBLE HAMPER WITH SWINGING LID

PRIOR APPLICATIONS

The present invention claims benefit of U.S. Patent Application No. 63/254,459, filed Oct. 11, 2021; the contents of which are incorporated herein by reference.

FIELD OF THE INVENTION

The present invention relates to the field of storage containers, particularly those that are collapsible and optionally portable. One embodiment is a hamper for storing laundry and other items. This embodiment can easily be assembled, disassembled and folded to provide the advantages of convenient storage, use and ease of display and also provide a decorative hamper that is attractive to the eye when assembled for use.

SUMMARY AND OBJECTS OF THE INVENTION

This Summary describes several embodiments of the presently-disclosed subject matter, and in many cases lists variations and permutations of these embodiments. This Summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently-disclosed subject matter, whether listed in this Summary or not. To avoid excessive repetition, this Summary does not list or suggest all possible combinations of such features.

It is one object of the present invention to provide a hamper for storing laundry and other items.

Hampers and household storage bins or containers are commonly used in homes to collect and store household items. Typical hampers and bins include two basic types: free-standing containers and support frame/bag designs. The free-standing containers typically are rectangular or oval in shape and are made of a hard, non-flexible material, such as plastic or wicker. With their rigid construction, these containers take up the same amount of space whether full or empty of laundry and, because they are not collapsible, they are not easily moved from one place to another. Additionally, these rigid wall hampers that are collapsible, are more expensive to ship. Because of their bulky size, they required a large volume of merchandising space. Additionally, because of the large volume of merchandising space required, merchandisers were unwilling to keep large quantities of such products on shelves, thereby making sales of such products even more inefficient because items were frequently not available for purchase on shelves.

Embodiments of the present invention to not have these restrictions.

This, it is another object of the present invention to provide a hamper which can be collapsed into a relatively thin package for storage, transport and display.

It is a further object of the present invention to provide a collapsible hamper which can be assembled by users with little difficulty.

A still further object is to provide a collapsible hamper which includes a swinging lid or door that allows laundry or other items to be placed in the hamper which is later closed.

One embodiment of the present invention is four-sided hamper with a front wall, two side walls, and a rear wall. It also includes a lid, which may be completely detachable from the walls, or an extension of the rear wall. The lid rests in top of the four walls. It has at least one flap that removably attaches the lid to the side walls. The lid also includes a door frame that removably attaches to the front wall, and a swinging door that is framed by the door frame.

These and other objects of the present invention will become readily apparent while reviewing the preferred embodiments and examples of the present invention disclosed herein in the description of the invention below and the accompanying drawings.

BRIEF DESCRIPTION OF THE DRAWINGS

In the accompanying drawings, which form a part of the specification and is to be read in conjunction therewith in which like reference numerals are used to indicate like or similar parts in the various views.

DESCRIPTION OF THE INVENTION

Figure 1:
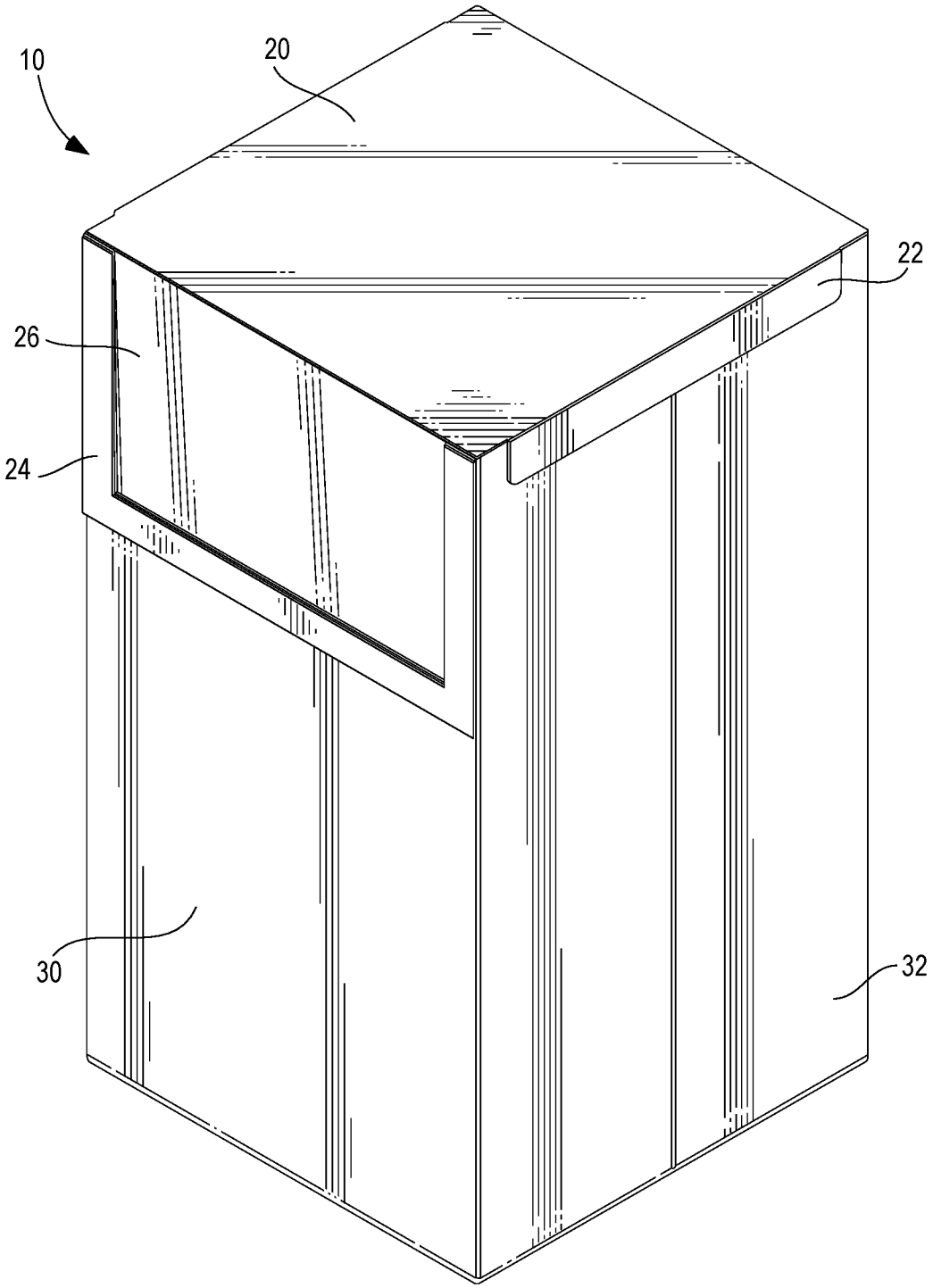
FIG. 1 shows a perspective view of an embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

As stated above, the present invention relates to a four-sided hamper with a front wall, two side walls, and a rear wall. It also includes a lid, which may be completely detachable from the walls, or an extension of the rear wall. The lid rests in top of the four walls. It has at least one flap that removably attaches the lid to the side walls. The lid also includes a door frame that removably attaches to the front wall, and a swinging door that is framed by the door frame.

Turning to the figures, FIG. 1 is a perspective view of a hamper 10 of the present invention. It shows the front wall 30 and one of the side walls 32. Also shown is the lid 20 on top of the hamper 10. The lid 20 has at least one flap 22 that removably attaches to a side wall 32. One method of attachment is a hook and loop type method such as with Velcro. The lid 20 also has a door frame 24 that removably attaches to the front wall 30. It may also use Velcro as an attachment method. The door frame 24 borders a swinging door 26 that hangs from the lid 20. Optionally, the lid can be permanently attached to the real wall and removably attached to the front wall and side walls. In this embodiment, when the lid is removed from the front and side walls, it hinges with the real wall.

The walls are rigid to promote support of the container and collapsibility. The walls are inwardly bendable generally along a seam fold line such that, when bent, the side walls approach one another. For the purposes of the present invention, the term rigid or rigid wall refers to both rigid and semi-rigid walls, and such term is intended to exclude only walls that are completely flaccid and flexible, such as clothes walls. As indicated above, the walls have to be ridged enough to support the bin. Generally speaking, the walls may comprise a cardboard, paperboard, or extruded polymer core covered by a fabric sheet. Other options include a polymer or even wood or wicker weave material. If a core is covered, there may be one material on the inside and another material on the outside. A "fabric" can be a cloth produced especially by knitting, weaving, or felting fibers of any type. A wicker material can be interwoven wooden or polymer strips.

A bottom portion (not shown) can be optionally provided. It can be attached to the side walls in a similar manner as the top or can be optionally flexible and permanently attached to the side walls. The flexibility of this option does not affect the folding of the hamper.

Figure 2:
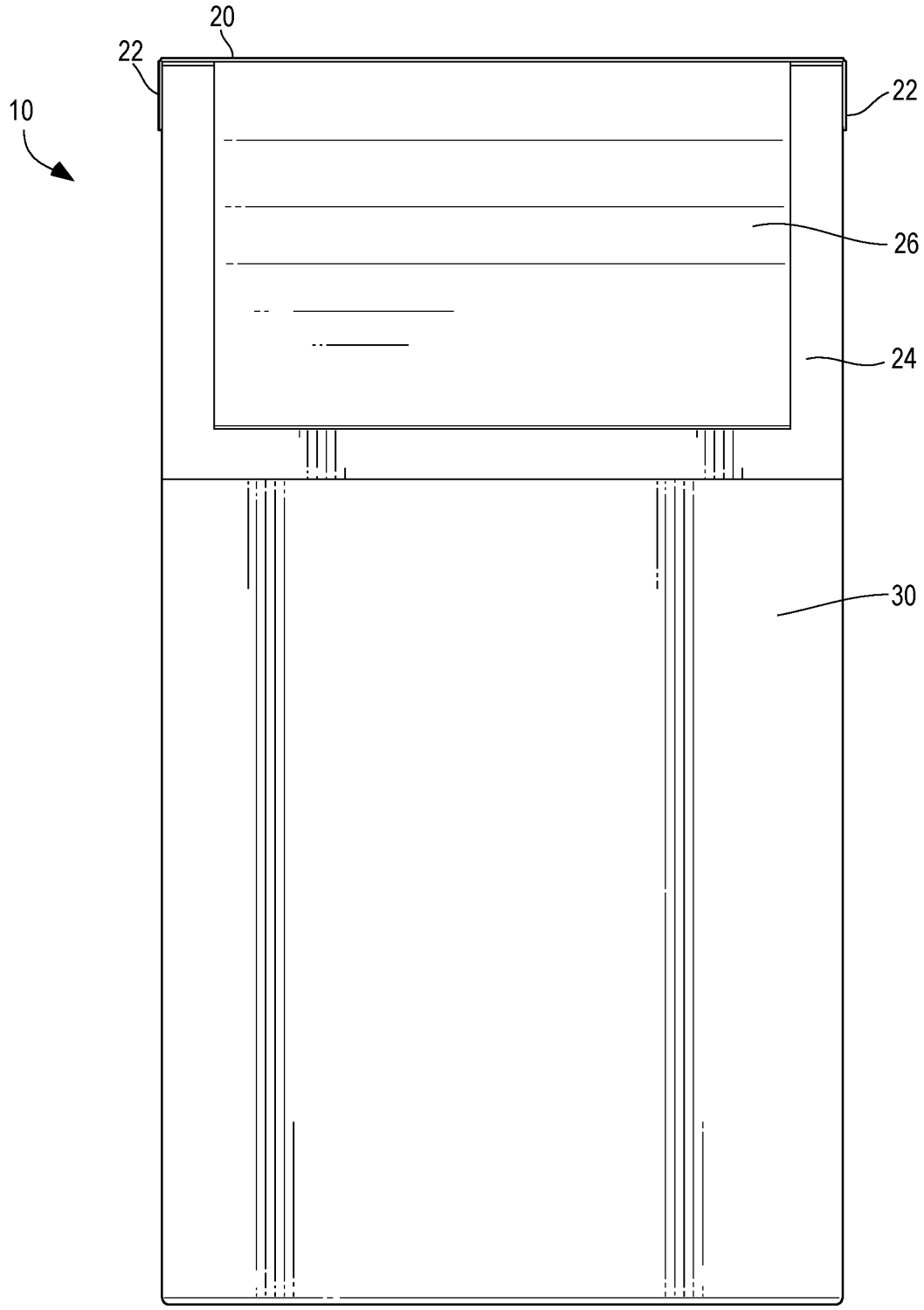
FIG. 2 shows a front view of an embodiment of the present invention.

FIG. 2 shows a front view of an embodiment of a hamper 10 of the present invention. The door frame 24 is attached to the front wall 30. The door 26 swings inward, behind the door frame 24. The door 26 is attached to the lid 20. This view also shows the side panels 22 that are attached to the side walls.

Figure 3:
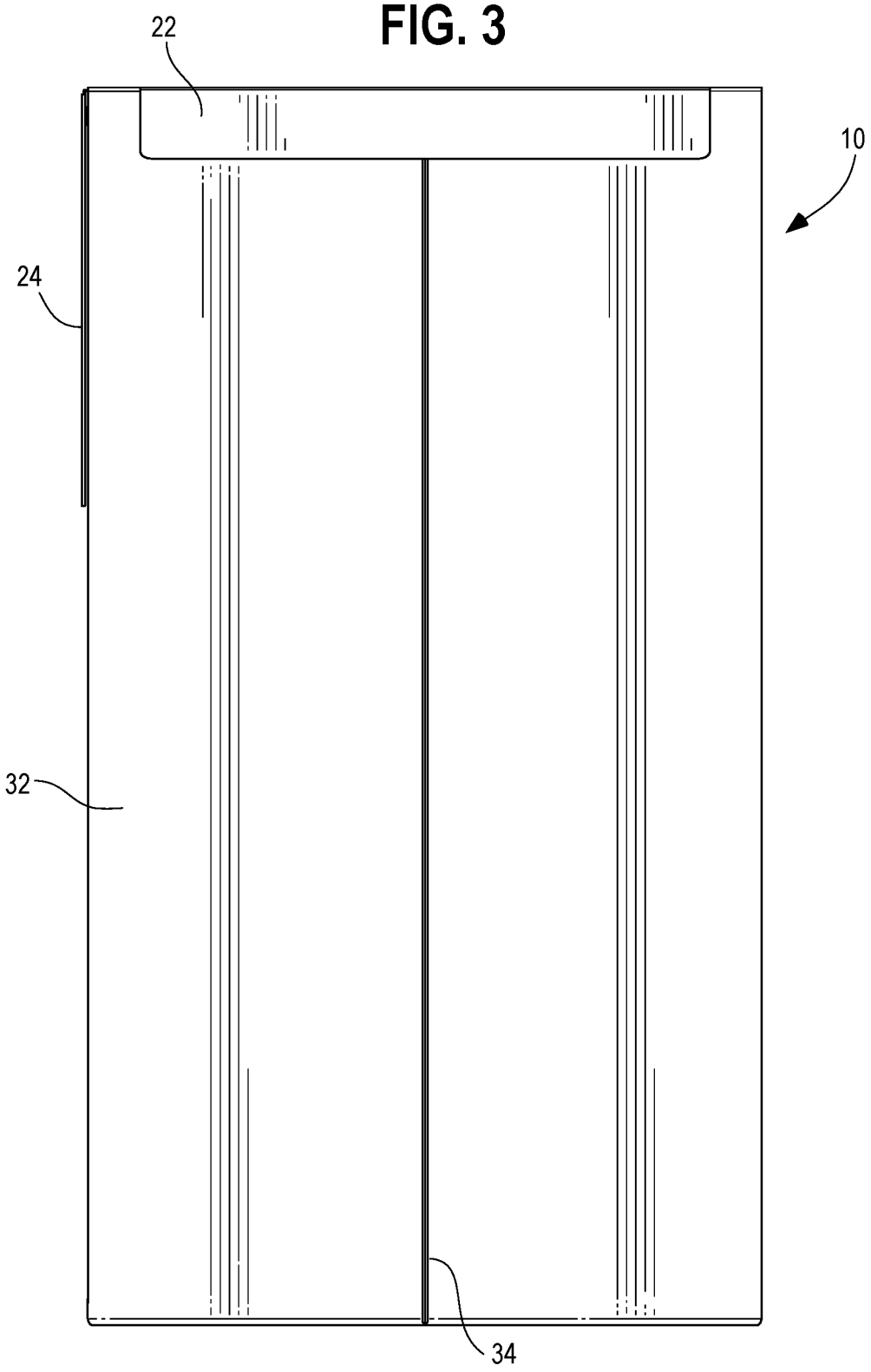
FIG. 3 shows a side view of an embodiment of the present invention.

FIG. 3 shows a side view of a hamper 10 of the present invention. A side wall 32 is shown with a flap 22 attached thereto. The door frame 24 is also shown, attached to the front wall. The side wall 32 includes a seam 34 to facilitate folding when the hamper is collapsed and folded. The seams essentially divides the side walls into left and right side walls along the seam. The hamper can be folded when the top is removed or partially removed, and the side walls are folded inwardly upon themselves which brings the side walls nearer to one another. When moving to a collapsed or folded state, the side panels eventually become generally adjacent to one another and the hamper is generally flat.

Figure 4:
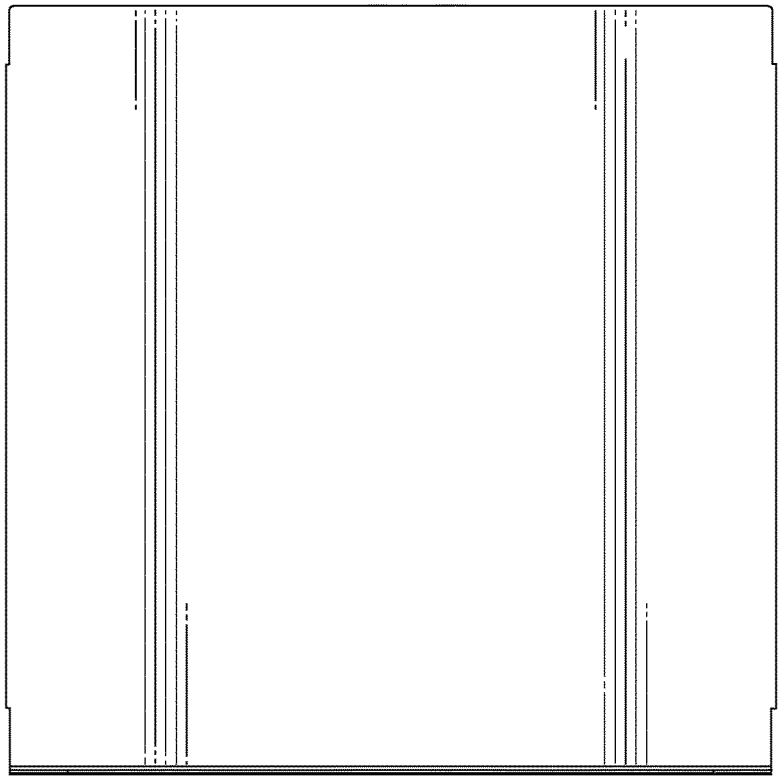
FIG. 4 shows a top view of an embodiment of the present invention.
Figure 5:
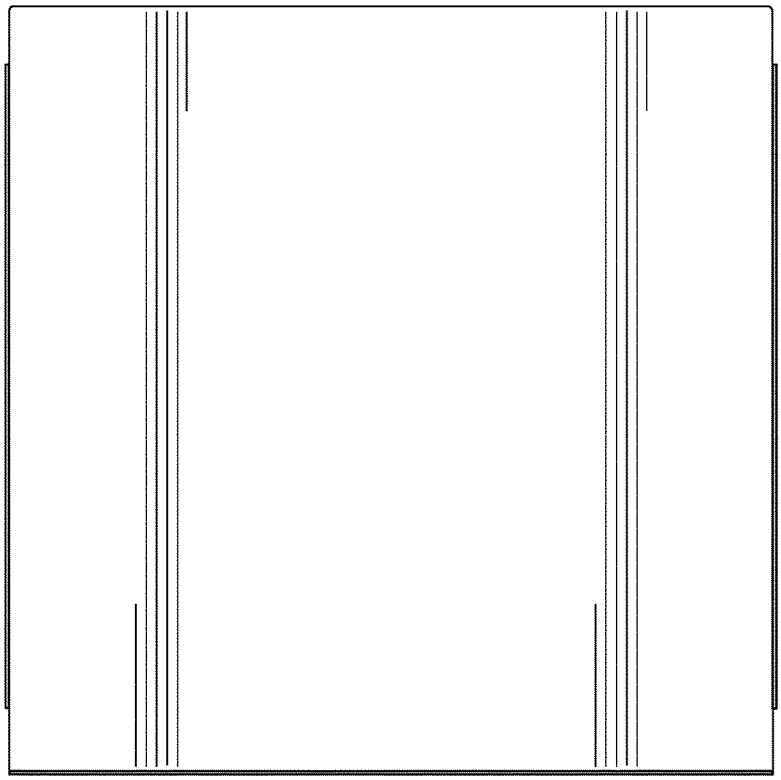
FIG. 5 shows a bottom view of an embodiment of the present invention.

FIGS. 4 and 5 show top and bottom views of the embodiment shown in FIG. 1, respectfully.

Figure 6:
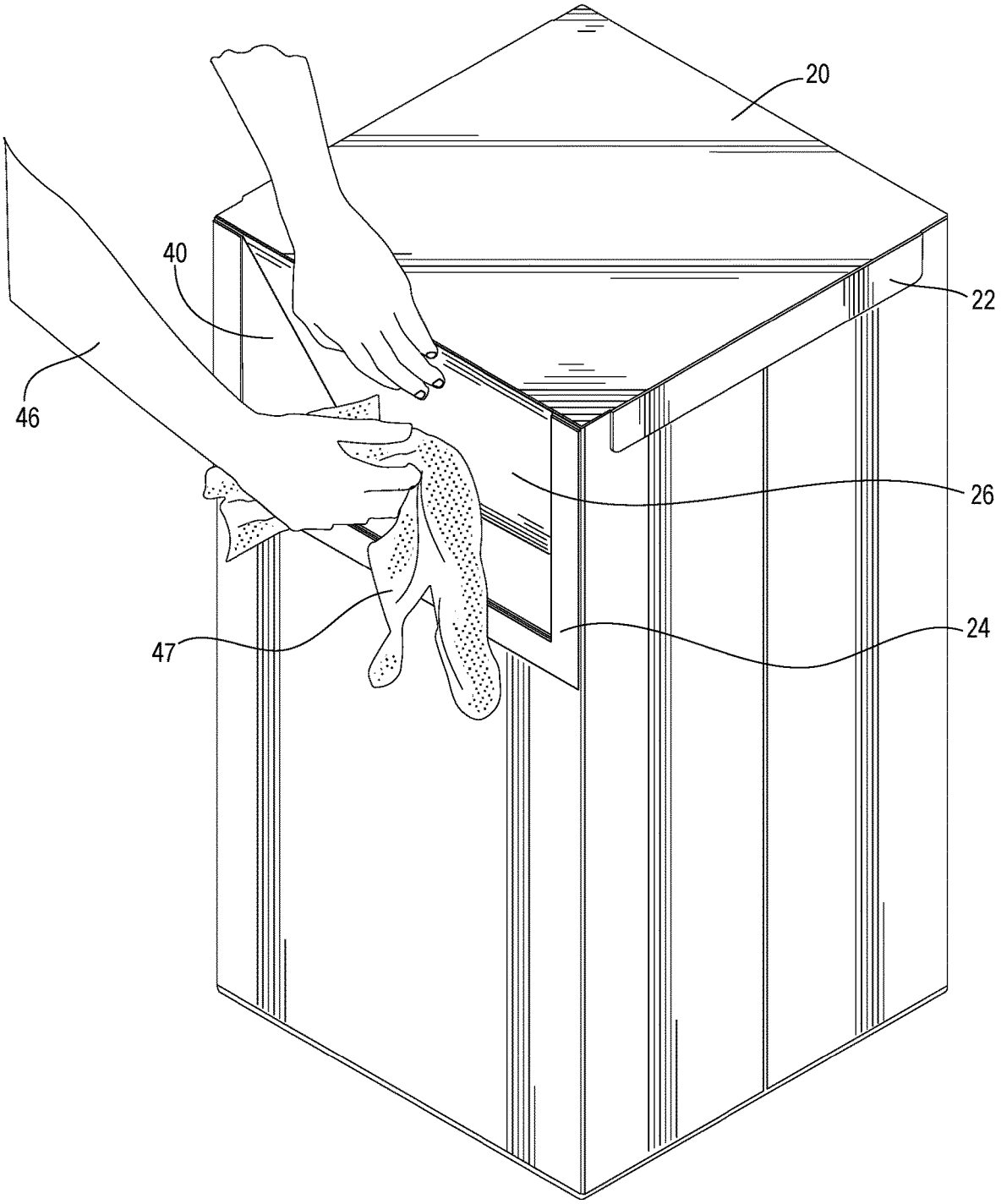
FIG. 6 is a perspective view of the embodiment of FIG. 1, in use.

FIG. 6 shows the embodiment depicted in FIG. 1, in use. The door 26 is open to expose and grant access to the hamper inner cavity 40. A user 46 is placing an article of clothing 47 into the hamper 10.

Figure 7:
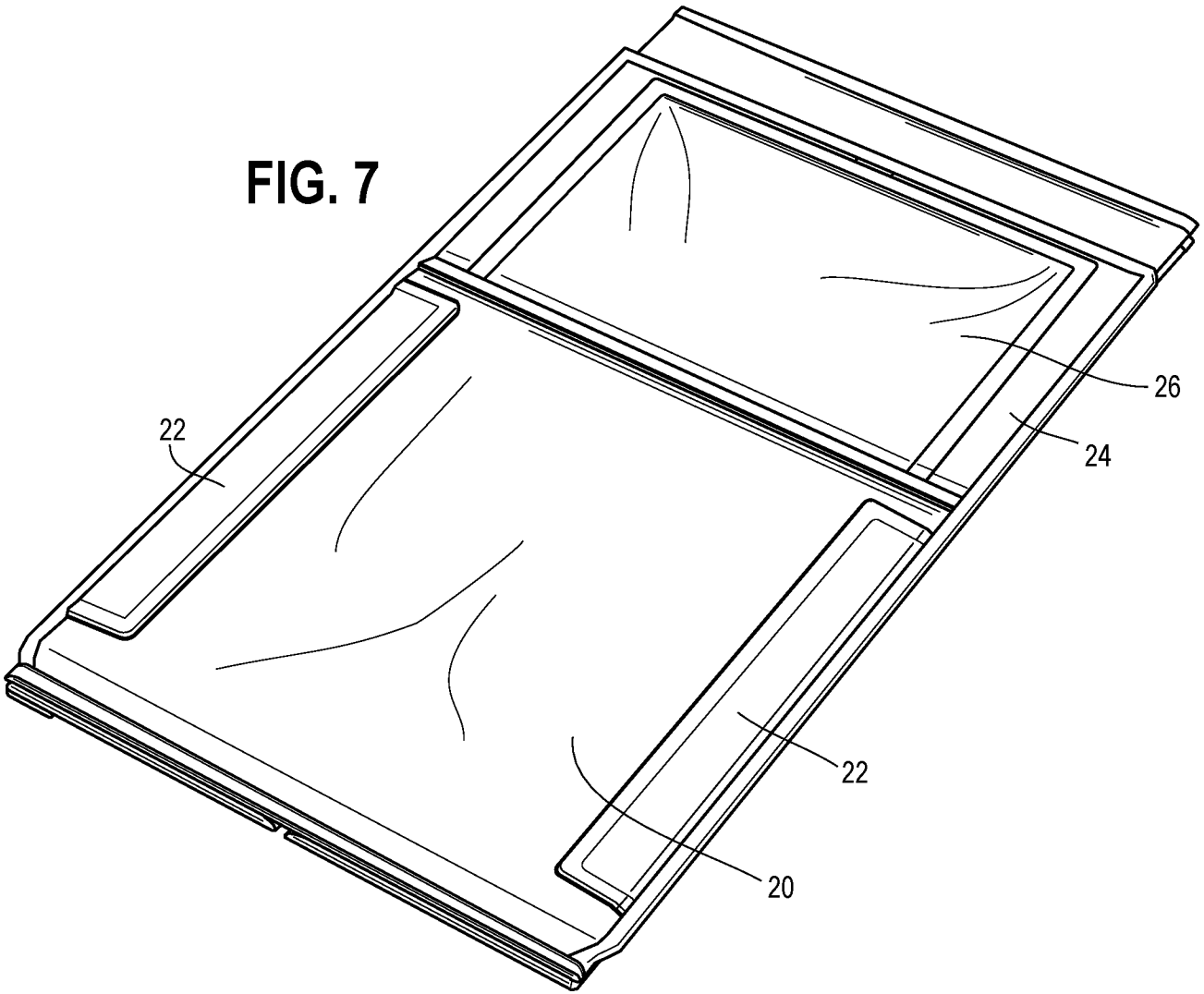
FIG. 7 is a perspective view of the embodiment of FIG. 1, in a collapsed or folded position.

FIG. 7 shows an embodiment of the present invention in a folded or collapsed state. The sides have folded along the seams shown in FIG. 3. The lid 20 and associated flaps 22 are shown on the top of the folded hamper, and the door frame 24 and swinging door 26 are as well.

Figure 8:
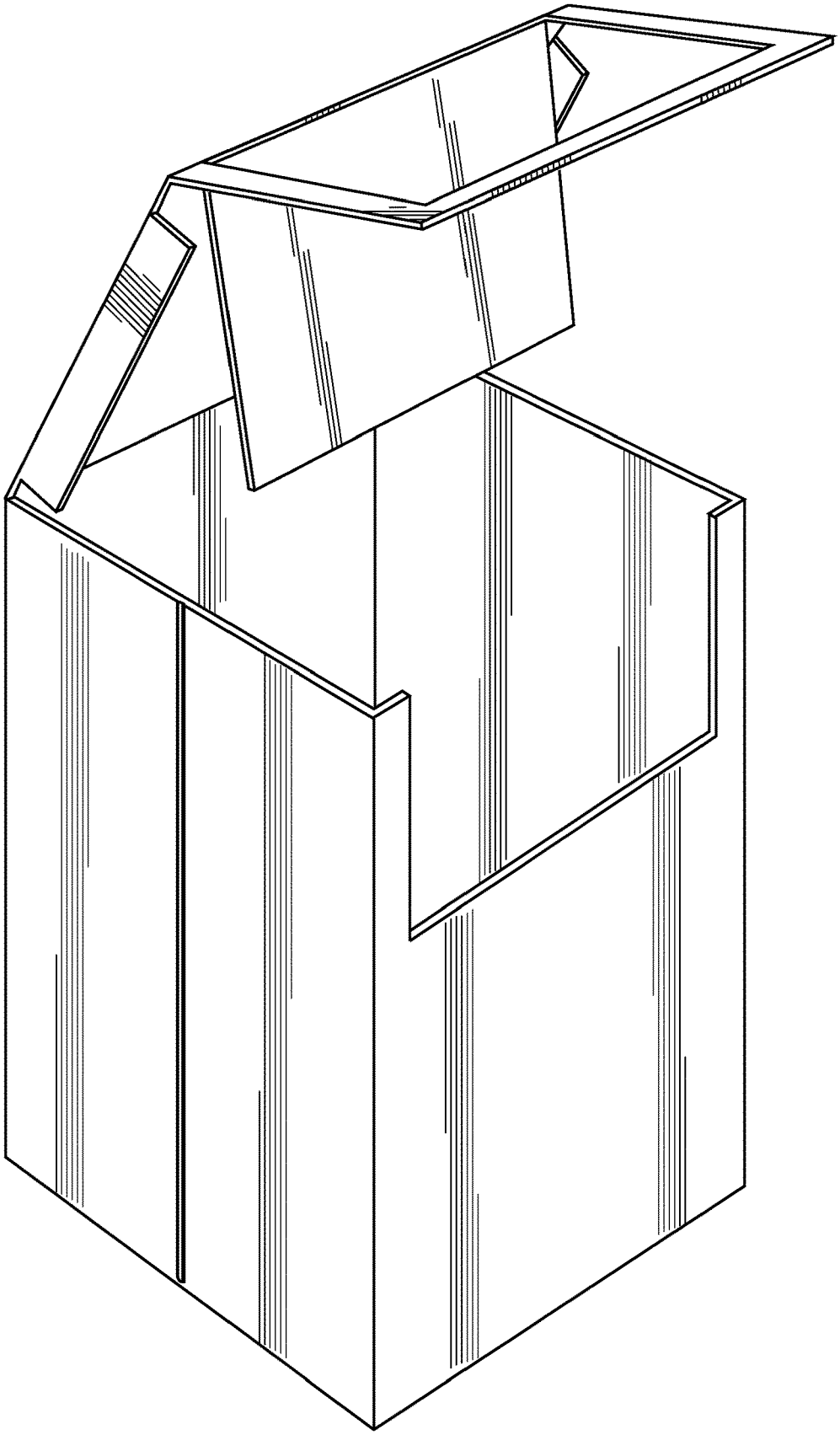
FIG. 8 is a perspective view of the embodiment of FIG. 1, with the lid and door partially raised, before being attached to the sides.

FIG. 8 shows the hamper in a partially assembled state, before the lid 20 is attached to the sides. The flaps are shown, as is the door frame and the swinging door.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the disclosure. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention.

We claim:

1. A foldable hamper, comprising:

a rigid front wall and rear wall;

two rigid side walls engaging the front and rear walls, forming an interior space;

a lid that removably engages the front wall and the side walls, the lid having a top, two side flaps, a door, and a door frame, the door being attached to the top of the door frame and configured to swing inward into the interior space to permit access to the interior space;

wherein each side flap extends over the edge of a side wall and removably attaches to the side wall, and the door frame extends over the front wall and removably attaches to the front wall;

and wherein the side walls have a seam that permits each of the side walls to inwardly bend toward one another to allow the hamper to be transitioned between a folded flat state and an expanded rectangular state.

2. The foldable hamper of claim 1, wherein the front wall has a door cavity that corresponds with the door to create an opening into the interior space when the door swings inwardly to the interior space.

3. The foldable hamper of claim 2, wherein the door frame attaches to the front wall below and alongside the door cavity.

4. The foldable hamper of claim 1, wherein the interior space is rectangular.

5. The foldable hamper of claim 1, wherein the door frame swings from the top to wrap around the front wall.

6. The foldable hamper of claim 1, wherein the rigid front wall, rear wall, and two rigid side walls comprise cardboard or paper board.

7. The foldable hamper of claim 6, wherein the walls comprise an outer fabric.

8. The foldable hamper of claim 1, wherein the lid engages the front and side walls by hook and loop.

9. A foldable hamper, comprising:

a rigid front wall and a rigid rear wall;

two rigid side walls each engaging the rigid front and rigid rear wall to form an interior space;

a lid that is removably attachable to the front wall and the side walls, the lid having a top, two side flaps, a door, and a door frame, the door being hingedly attached to the top of the door frame and configured to swing inwardly into the interior space;

wherein each side flap extends over the edge of a side wall and is removably attachable to the side wall, and the door frame extends over the front wall and is removably attachable to the front wall;

wherein the side walls have a seam that permits each of the side walls to inwardly bend toward one another to allow transitioning the foldable hamper between a folded flat state and an expanded rectangular state; and further wherein the front wall has a door cavity that corresponds with the door and the door frame attaches to the front wall below and alongside the door cavity.

10. The foldable hamper of claim 9, wherein the interior space is rectangular.

11. The foldable hamper of claim 9, wherein the door frame swings from the top to wrap around the front wall.

12. The foldable hamper of claim 9, wherein the rigid front wall, rear wall, and two rigid side walls comprise cardboard or paper board.

13. The foldable hamper of claim 12, wherein the walls comprise an outer fabric.

14. The foldable hamper of claim 9, wherein the lid engages the front and side walls by hook and loop.

* * * * *